United States Patent [19]

Denay

[11] 4,239,114

[45] Dec. 16, 1980

[54] CONTINUOUS ASSEMBLIES OF POSTAL CORRESPONDENCE UNITS

[75] Inventor: André M. J. Denay, Chevilly Larue, France

[73] Assignee: Société Herve & Fils S.A., Paris, France

[21] Appl. No.: 720,398

[22] Filed: Sep. 3, 1976

[30] Foreign Application Priority Data

Sep. 9, 1975 [FR] France ..... 75 27578

[51] Int. Cl.[3] ..... B65D 27/10; B65D 27/34

[52] U.S. Cl. ..... 206/610; 229/69

[58] Field of Search ..... 229/69, 85, 92.1, 92.3; 206/610

[56] References Cited

U.S. PATENT DOCUMENTS

| | | | |
|---|---|---|---|
| 576,552 | 2/1897 | Cook | 229/92.1 |
| 2,226,574 | 12/1940 | O'Brien | 229/69 |
| 3,273,785 | 9/1966 | Beckman et al. | 229/69 |
| 3,837,565 | 9/1974 | Johnsen | 229/69 X |
| 3,902,655 | 9/1975 | Huffman | 229/85 X |

*Primary Examiner*—Stephen P. Garbe

*Attorney, Agent, or Firm*—Edwin E. Greigg

[57] ABSTRACT

In a continuous assembly of mailers or items of postal correspondence with incorporated documents, the incorporated document in each mailer is constituted by a leaf comprising a top flange and a detachable portion or by a pad of such leaves, not necessarily of the same dimensions, joined through their flanges and provided if necessary with selective transfer means from one leaf to the other, or again by a pad composed of heterogeneous elements. The latter may be leaves, folded printed forms with crossed or uncrossed folds, return envelope, fascicles, plastic cards or the like joined together by respective detachable flanges formed or fastened at the top of said elements. The assembly has a continuous base strip divided into panels, each panel being bounded by two transverse lines of weakness provided for the accordion-folding of the strip. Each incorporated document is fastened to a respective panel by glueing at the top transversely to the strip. Perforations enable the strip to be driven in a printing machine. Envelopes of items of correspondence are formed by folding each of the panels after their separation and glueing, or by assembly by glueing with another continuous strip called a cover strip, each panel thereof having at least one tear line enabling the opening of each of the envelopes so formed.

5 Claims, 21 Drawing Figures

F
12
11
13
28
10
3
4
7
5a
8
6
1
2
5b
5c
27
20
25b
26b
26
26c
19b
26a
18
23
22
19a
25
25a 19a
2
20
23
24
6
18
1
22
19b
26
26a
26b
26c
25a
25b
25c
21
27

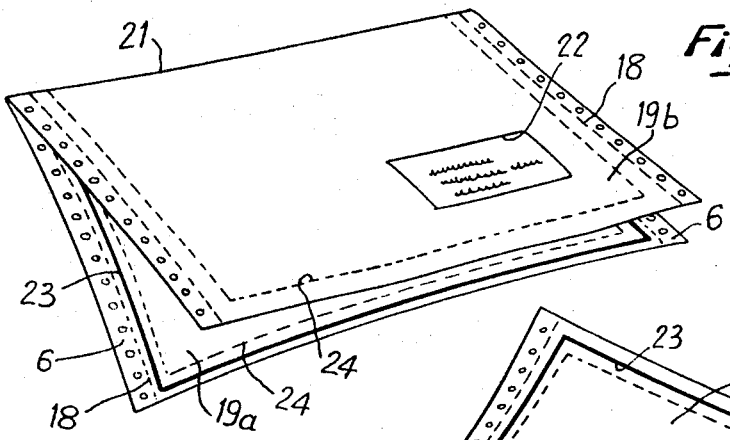
Fig:6b
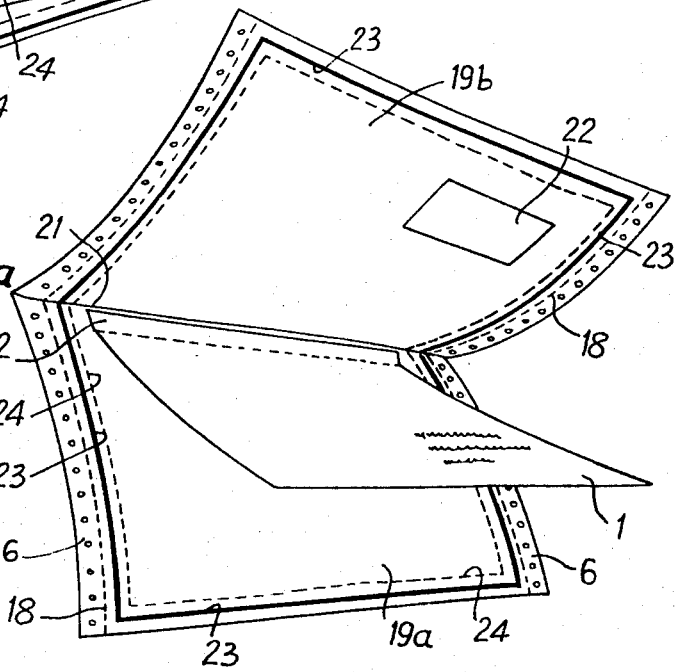
Fig:6a
Fig:7a
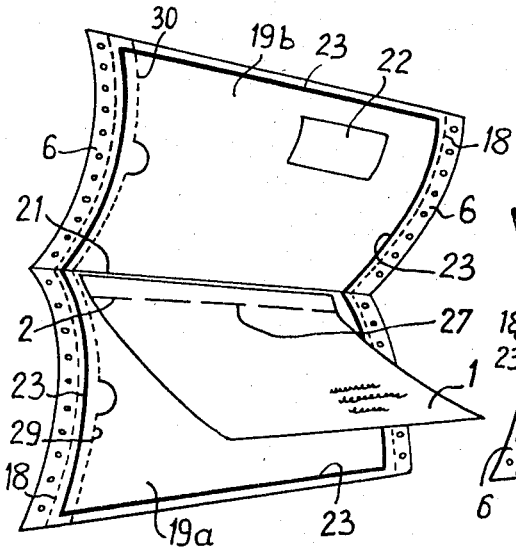
Fig:7b
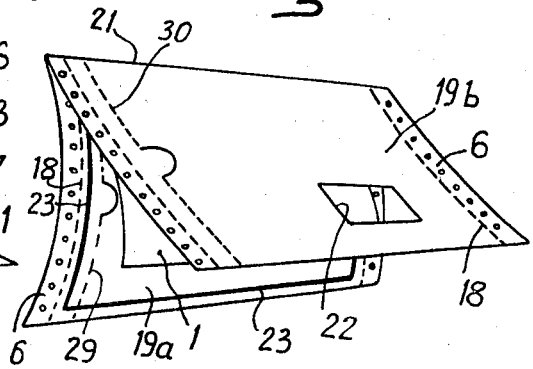

CONTINUOUS ASSEMBLIES OF POSTAL CORRESPONDENCE UNITS

BACKGROUND OF THE INVENTION

1. Field of the Invention

The present invention relates to continuous assemblies of postal correspondence units with incorporated detachable documents.

2. Description of the Prior Art

In order to facilitate the processing of office forms for mass correspondence, there exist in commerce various types of continuous assemblies designed to pass through a suitable office printing machine, for example, the print-out device of a computer. These assemblies are delivered to the user folded accordion-style along transverse lines of weakness, each panel of the accordion element constituting a postal correspondence unit, sealed in manufacture or sealable after folding. After passage through the print-out device, the "separation into units" of the assembly is carried out by separating the panels from one another in a breaker or in a cutting device. Mostly, the assembly is provided with marginal perforations serving for driving it through the processing machines and the perforated margins are detached either by continuous cutting in the breaker or the transverse cutting device or by the addressee by means of the longitudinal detachable perforations.

Of course, the assembly can receive in the course of manufacture, over the whole or part of the surface of one or several of the elements which constitute it, printing of a general nature (business letter-head of the sender, indication of the time for reply, list of products of services placed at the disposal of the addressee, method of settlement, form to be filled, etc..) as well as various markings (trade mark, signs, patterns for decoration or to prevent reading by transparence of the closed folder), this printing and marking then being repeated on each panel and only the personalised printing, relating to a given addressee being done on the office printing machine.

When each unit of correspondence is sealed in manufacture, the assembly is in the form of a bundle of superposed and continuous paper strips on which the particular information printed by the office printer is selectively reproduced by known means (carbon areas, reactive papers, self-reproducing paper, etc.). Such articles are commonly denoted by the English term "mailers". Separately from a first possible strip, called the recording or checking strip, which receives all the information printed by the office printer, the top strip forms the upper wall of the envelopes of the successive folders and the lower strip the back wall of said envelopes which are sealed by two longitudinal glueing lines which follow the detachable lateral margins of the assembly and transverse glueing lines framing each of the lines of weakness provided by folding in accordion fashion. All the intermediate strips are intended to form the internal documents which can include an envelope called a return envelope and for this they are suitably cut out so as not to be "stuck" at least by the transverse adhesive. Lines of detachable perforations or of breakage starting are formed on certain strips or on all of the strips so as to permit for each unit folder, its opening and the seizing of the incorporated documents by tearing away of at least one transverse or lateral strip or, automatically, by a sudden pull applied at a certain point. Mostly the intermediate strips are assembled together and with the top and bottom strips by one only of their longitudinal edges, that is to say each inside document has three free edges and one detachble lateral edge.

These "mailers" have a certain number of drawbacks. Firstly, the assembly into a bundle of the different strips requires a machine of very specialized formation, large and of high cost which, supplied by as many spools as there are strips, provides for the cutting-out of the intermediate strips, the glueing, the lateral assembly strips and the formation of folders for the accordion folding. Moreover, when the intermediate strips are held by one only of their lateral edges, the latter presents with respect to the other, an excess thickness which interferes with the formation of a "bundle" of the accordion folding and limits the possible number of inside documents which, besides, cannot have notable differences as to their dimensions as for that corresponding to the transverse direction of the strips. Lastly, the folders being sealed in manufacture, none of the inside documents can receive a direct impression from the printer, which prevents their passage through optical or magnetic readout machines.

There have been proposed, continuous assemblies of mailers not sealed in manufacture, of the letter-card type. In these assemblies each panel of the accordion elements includes at least three flaps which can each receive a direct impression. According to the number of flaps and the method of folding provided for the letter-card (folding accordion-style or rolled folding) the address of the addressee is borne directly on the flap forming the face of the sealed folder or appears through a window formed on said face flap after having been struck on another. After passage through the printer the various panels are separated as has been stated above and each correspondence unit is folded along weakness lines separating the different flaps, preferably in a suitable folding machine, and sealed automatically by simple pressure due to lines of self-adhesive areas or by pressure and heating by means of thermo-adhesive stripes. On reception, the addressee opens these folders by detaching narrow strips, by means of the lines of detachable perforations, on three sides or at least on two opposite sides and unsticking the third when it involves self-adhesive areas.

These letter-cards have however certain drawbacks. The principal drawback resides in the limitation of the number of flaps. It is difficult to exceed three flaps whilst remaining within reasonable limits as to the length of the panels of accordion folding of the continuous assembly. If all the flaps can receive a direct impression, contrary to the internal documents of a "mailer", it is not possible to obtain on an end flap detachable by the user, a lower free edge for optical read-out (reply-card, universal payment voucher) except if the separation into units is effected by cutting (guillotine or rotary knife) and not by a breaker. Lastly, if the detachable flap has to include two free edges (lower edge and right-hand edge) to pass into a magnetic read-out machine (cheque for example) it is necessary for the corresponding flap to be cut laterally on the right-hand side, during manufacture, which involves interruptions in the right-hand lateral driving margin and the possibilities of mishaps.

In all cases the internal documents are derived from the single continuous strip (letter-cards) or are obtained by flat cutting-out of intermediate strips paid out from spools ("mailers"). It is impossible to incorporate in the correspondence units of these continuous assemblies, documents arising from other sources of mechanical or manual formation, such as a large cross-folded printed form, a plastic card, a fascicle or a catalogue, etc...

Finally, it is known, besides, to attach by glueing to a simple continuous strip provided with marginal perforations or any other drive means, single leaves, wads of leaves, pockets, etc., so as to enable such elements to pass through an automatic printer. The continuous strip is then called a support strip or pilot strip. The forming machines enabling this to be carried out are simple machines, relatively inexpensive and which, until now, can effect this positioning of the attached elements in extremely accurate manner.

OBJECTS AND GENERAL DESCRIPTION OF THE INVENTION

In order to eliminate the drawbacks and to reduce the cost price of mass correspondence units, to enable the incorporation in each folder of heterogeneous documents coming from one or several independent forming stations and, for certain purposes, to obtain at least one internal document printed directly by the printer, the invention provides that in each unit the document incorporated is constituted by a leaf including a top flange and a detachable portion or by a pad of such leaves, not necessarily of the same dimensions, joined by their flanges and provided if necessary with selective transfer means from one leaf to the other, or again by a pad composed of heterogeneous elements such as leaves, folded prints which crossed or uncrossed folds, return envelope, fascicles, plastic cards or the like connected together by respective detachable flanges formed or attached at the top of said elements, wherein each incorporated document is attached to a respective panel of a continous base strip, each document being glued at the top transversely to said base strip, each panel being bounded by two transverse weakening lines provided for the accordion folding of said continuous strip, the latter being provided with means enabling it to be driven in a printing machine, arranged to constitute the envelopes of correspondence units by folding each of the panels after separation of the latter and glueing or by assembly by glueing to another continuous strip called a cover strip and including for each panel at least one tear line enabling the opening of each of the thus constituted envelopes.

This general arrangement enables different types of correspondence units to be produced sealed in manufacture or sealable after their passage into the printer by simple pressure (self-adhesion) or pressure with heat (thermo-adhesion). The description which follows relates to the principal types possible, between which each user can choose according to the requirements themselves imposed on him by the operation to be carried out and the nature of the documents (dimensions of incorporated documents, necessity or not of obtaining a direct impression on the incorporated documents, addresses of the addressees appearing or not on the incorporated documents, etc.) or by the equipment that he has available (single impression printer, double impression or Y printer, unit separation equipment, possibilities of the automatic machine folding, etc.).

BRIEF DESCRIPTION OF THE DRAWINGS

The description refers to the accompanying drawing in which:

FIGS. 4*a* and 4*b*, 5*a* and 5*b*, 6*a* and 6*b*, 7*a* and 7*b* show respectively four modifications of a two flap folder;

DESCRIPTION OF PREFERRED EMBODIMENTS

Figures 1, 3A:
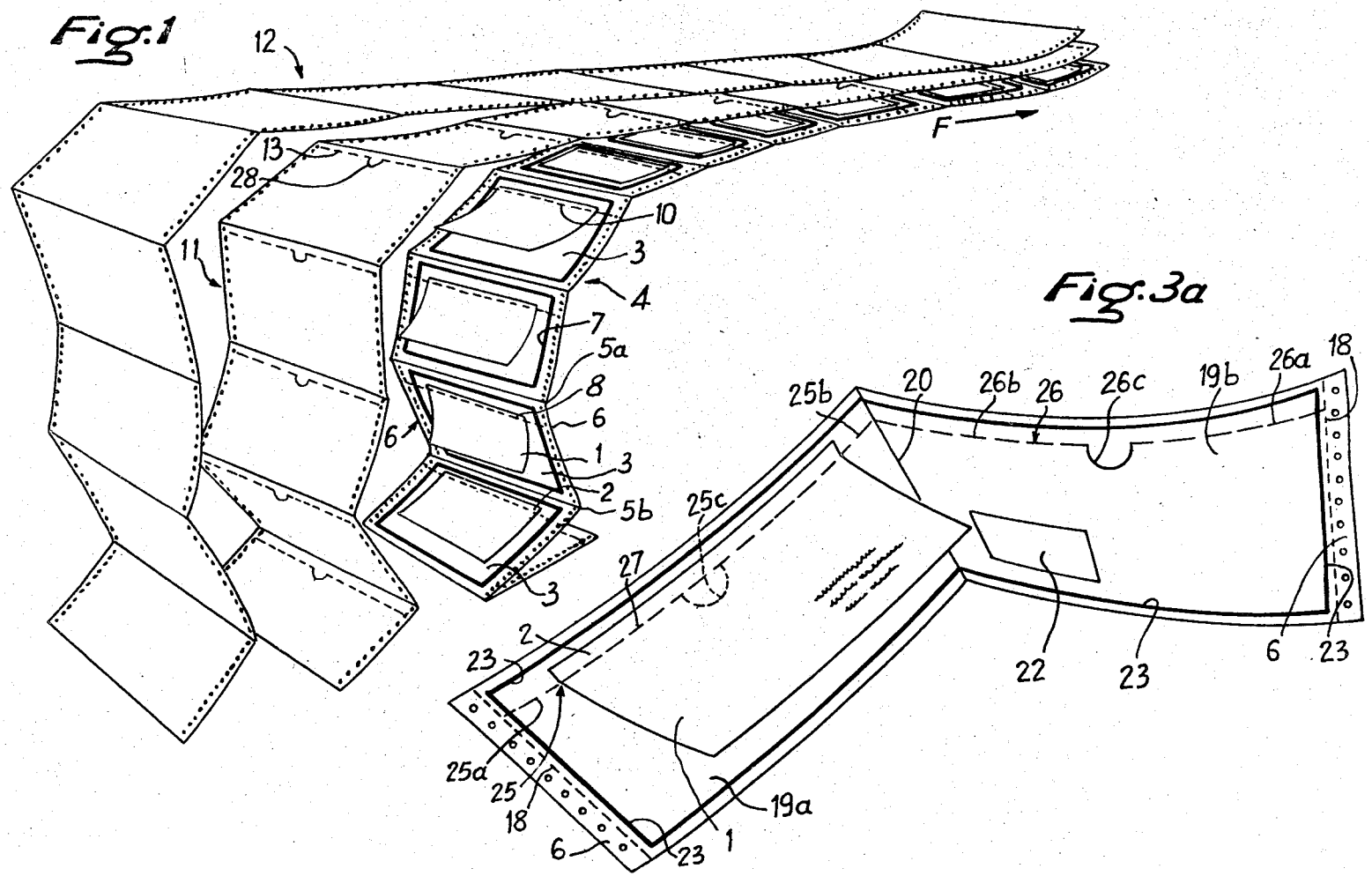
FIG. 1 shows an embodiment of an assembly of folders, according to the invention, sealed in the course of manufacture.
FIGS. 3*a* and 3*b* show one of the folders of an assembly comprising two flaps and intended to be sealed by folding.

In the following description, for all the types of assemblies described, everything which is placed inside the postal folder after the latter is sealed is denoted by "the incorporated document". This document may be a single leaf or a pod of leaves provided if necessary with selective transfer means from one leaf to the other, or again a heterogeneous group which can include one or several leaves, diverse elements such as folded prints, fascicles, envelopes, plastic cards or any other elements with a flat face and of relatively slight thickness. All the elements constituting the incorporated document are formed into a pad at the top either directly (leaves) or by means of flanges attached to said elements, or again after having fixed said elements on support leaves overlapping at the top, by means of incisions in the support leaves or adhesive "wedges" or vanishing spots of glue. The various elements of an incorporated document can arise from different respective forming stations, including manual forming stations. The dimensions can vary from one element to another.

The whole useful portion of each element or of the support leaf of each element is detachable from the narrow stacking strip which has the same width for all the elements or element supports. The glued stacking of these strips obtained by the assembly into a wad will be denoted below by the expression "the flange of the incorporated document" Thus the incorporated document can be separated from its flange by tearing or pulled off according to the resistance of the separating lines of each element.

Thus one characteristic of all the elements of the incorporated documents in the continuous assemblies of postal correspondence units according to the invention is to present all their free edges when they are arranged on the support leaves or three free edges when they are stacked directly In all the types of mailers according to the invention the incorporated document passes into the printer with a flange at the top and alone, consequently, the top edge of each element cannot be free. This is a feature which cannot be found in any other presently known assemblies.

In all the figures showing various embodiments of the invention, the assembly includes as the driving means, marginal strips of equidistant perforations. It is known that these strips can be cut in the unit-separating device or separated by the addressee by means of detachable lines of perforations. It is the latter case which has been assumed in making the drawing, but it must be understood that the strips could be eliminated for the drawing of a unitary postal cover. In the same way, any other known drive means could be adopted.

FIG. 1 shows the constitution of an assembly of folders sealed in manufacture according to the invention. Each incorporated document 1 is attached by glueing at the top of its flange 2 on a respective panel 3 of a continuous strip 4 called a base strip comprising means 6 for driving it in the forming machines and mechanographic printing machines, each panel of said strip extending between two transverse lines 5*a*, 5*b* of weakness enabling the accordion style folding of the continuous strip. This operation of glueing the incorporated documents is effected in a conventional machine (not shown) with high accuracy as regards the position of the document on its respective panel. In the same machine or at another station, the strip 4 receives glue stripes 7 extending parallel at a short distance from each of the four sides of each panel, it receives also a tear line 8. This tear line can be transversal as shown in FIG. 1, and it then coincides with the line of separation 10 of the flange from the incorporated document, or longitudinal as will be mentioned below.

The strip 4 is then directed along F to an assembly machine where it is assembled by clamping the marginal zones (an operation called crimp-locking) with a continuous strip 11 of the same width, called a covering strip and if necessary a strip 12 called a recording or checking strip. Each of these strips has transverse weakness lines dividing them into panels identical with those of strip 4. The cover strip 11 includes also on each panel, a tear line 13 which becomes applied exactly on the tear line 8 of the corresponding panel of the strip 4.

Each panel of the strip 11 and the corresponding panel of the strip 4 are fastened together over the whole of their periphery by the glue stripes 7. Of course, the latter instead of being arranged on the front of the strip 4 could be on the back of the strip 11. They could also be replaced by thermo-adhesive strips if heating rollers are available for their assembly or again by self-adhesive lines arranged in conjugate manner on the front of the strip 4 and the back of the strip 11.

The thus constituted assembly is folded in accordion fashion by means of the weakness lines of the strips.

In order that, subsequently, the impression of the printer should transfer to the upper element of the incorporated document through the cover strip 11, this element is self-reproducing or has a front reacting chemically with the back of the strip 11 or the latter includes carbon areas, all well-known arrangements, not being claimed in themselves in the present invention. In the same way, when the strip 12 is present, it is possible to obtain a selective transfer of the impression of the printer on the front of the strip 11 through the strip 12.

After opening out the strip 12 and separation into units by breaking or cutting the weakness lines of the strips 4 and 11, a plurality of sealed envelopes is obtained whose face is constituted by the front of a panel of the strip 11 and the back by the rear of a panel of the strip 4. The tearing of the superposed lines 8 and 13 enables the opening of the envelope by the addressee and extraction of the document 1. This extraction can be automatic as will be explained below.

Figures 2, 3B:
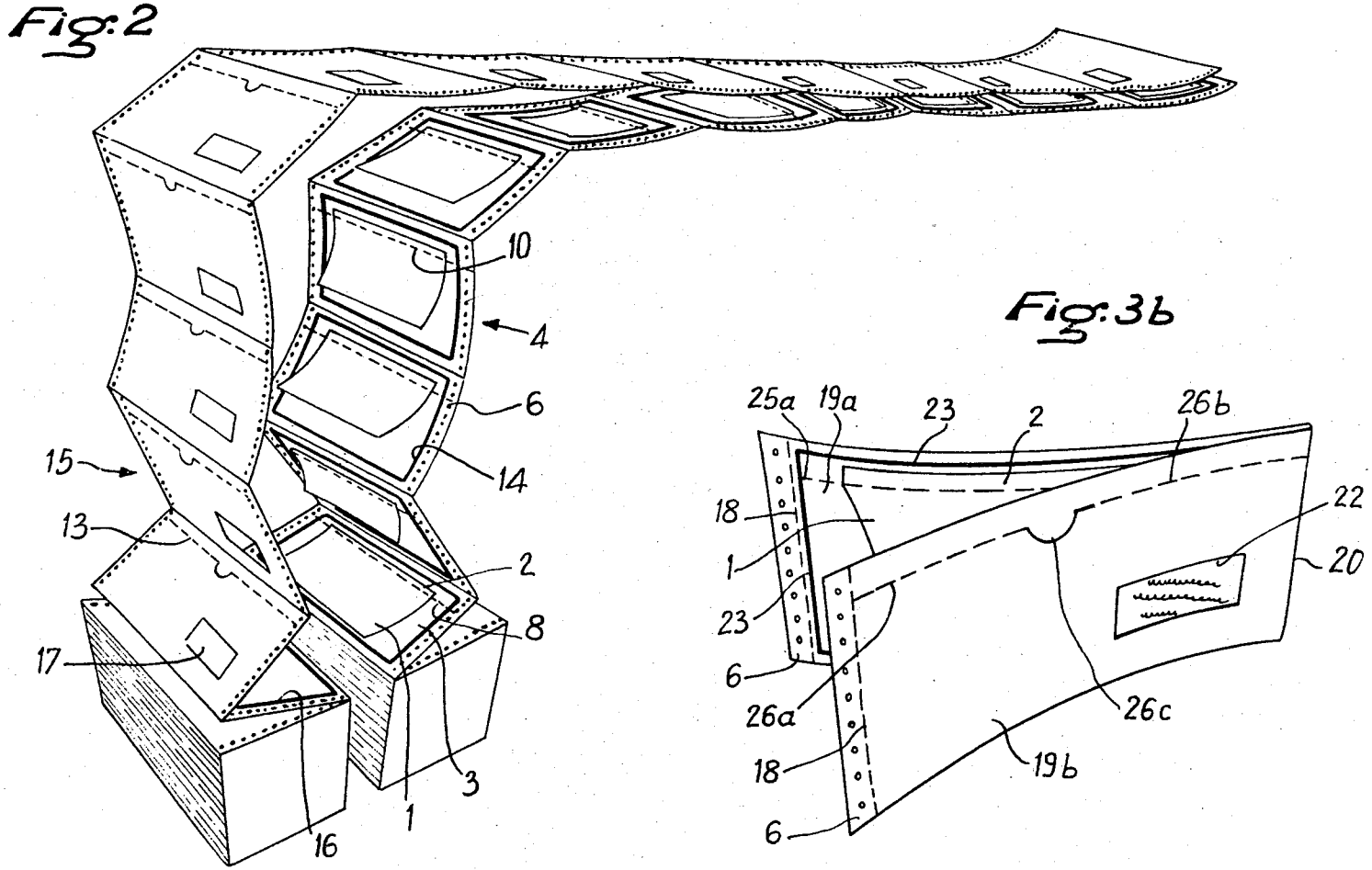
FIG. 2 shows an embodiment according to the invention of a continuous strip of folders sealed by covering after their passage through the printer.
Figures 4A, 4B, 5A, 5B:
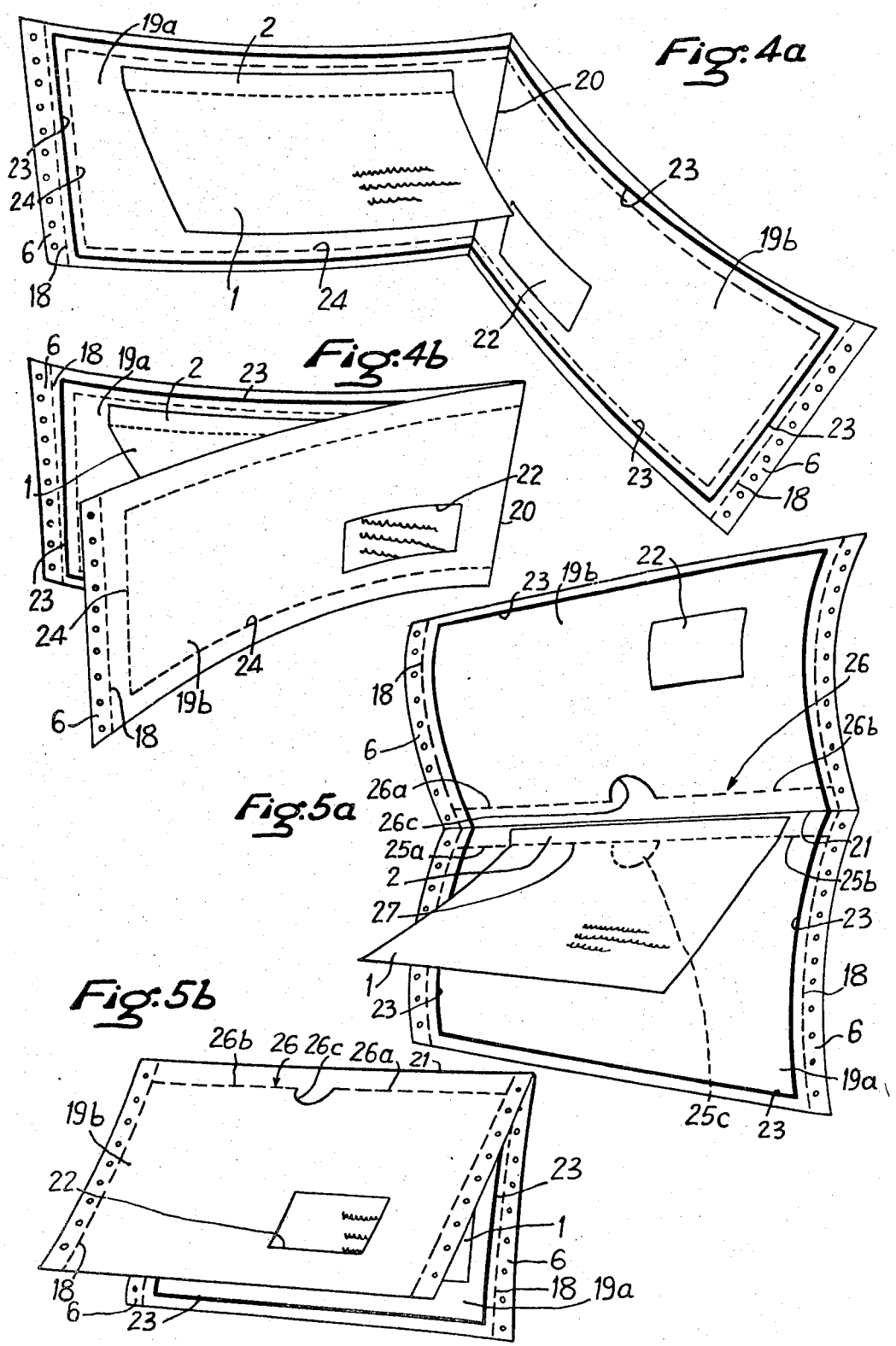

FIG. 2 shows a modification in which the folders are not sealed in manufacture but only by the user after passage in the printer. This arrangement is adopted to obtain a direct impression on the first element of the incorporated document. It is not possible therefore to have here an or checking strip such as 12. Here again, each incorporated document 1 is attached by glueing at the top of its flange 2 to a panel 3 of a continuous base strip 4. Since the strip is intended to pass as is into the printer, it is delivered to the user folded accordion style. The peripheral glueing means 14 of each panel with the corresponding panel of the cover strip 15 can hence be only thermo-adhesive stripes or lines of self-adhesive areas conjugated with lines 16 borne by the back of said cover strip. Of course, the strips 4 and 15 include drive means and tear lines as in FIG. 1. The strip 15 not passing into the printer, each of its panels is provided with a window 17 arranged so as to become positioned during assembly, facing the zone of the incorporated document which receives the address of the addressee.

After passage into the printer and before separation into units, the two strips 4 and 15 are assembled in superposition, by means of glueing means 14–16 by passage between two pressure rollers, possibly heating.

In all the following embodiments the folders are sealed after passage into the printer, the incorporated document receiving a direct impression, by folding the base strip. There is no longer a cover strip, the assembly being replaced by folding which can be carried out in an automatic machine. Here again, the glueing means can be only self-adhesive or thermo-adhesive means. The lines of self-adhesive areas or the stripes of thermo-adhesive material will both be denoted by the expression "self- or thermo-adhesive lines".

In FIGS. 3*a*–3*b*, 4*a*–4*b*, 5*a*–5*b*, 6*a*–6*b* and 7*a*–7*b* only a single panel of a continuous base strip is shown on which an incorporated document is attached by glueing at the top of its flange 2. Said panel bears laterally, on each side, a fraction of the marginal strip 6 of perforations for driving the continuous strip, detachable by means of a tear line 18.

The panel is divided into two flaps 19*a* and 19*b*, foldable on one another by means of a longitudinal fold line 20 (with respect to the continuous base strip) in FIGS. 3*a*–3*b*, 4*a*–4*b*, or transversal at 21 in FIGS. 5*a*–5*b*, 6*a*–6*b* and 7*a*–7*b*.

The incorporated document is attached to the flap 19*a*. The flap 19*b*, which forms the face of the postal folder when it is folded back to the flap 19*a* thereby imprisoning the incorporated document, is provided with a window 22 which comes to face the zone of the incorporated document which receives the impression of the address of the intended recipient.

Self- or thermo-adhesive lines 23 extend parallel and at a short distance from the four sides of each panel. Thus when the two flaps are folded on one another, the folder can be sealed by simple pressure or by heat and pressure.

Various solutions can be adopted to effect the opening of the sealed folder.

In FIGS. 4*a*–4*b* and 6*a*–6*b*, there is provided, inside the frame formed on each panel by the self- or thermo-adhesive lines 23, a frame 24 of detachable perforations, which enables the opening of the folder by tearing three sides as for an ordinary letter-card.

In FIGS. 3*a*–3*b* and 5*a*–5*b* the panel comprises two transverse tear lines 25 and 26 symmetrical with respect to the longitudinal fold line 20 or transversal fold line 21. Each of these lines is formed by two segments 25*a* and 25*b* and 26*a*–26*b* of detachable perforations connected at the centre of said lines by a half-moon cut 25*c*, 26*c* whose convexity is turned towards the centre of the folder, and one 25 of these lines coincides with the separating lines 27 of the flange from the incorporated document.

Figure 8:
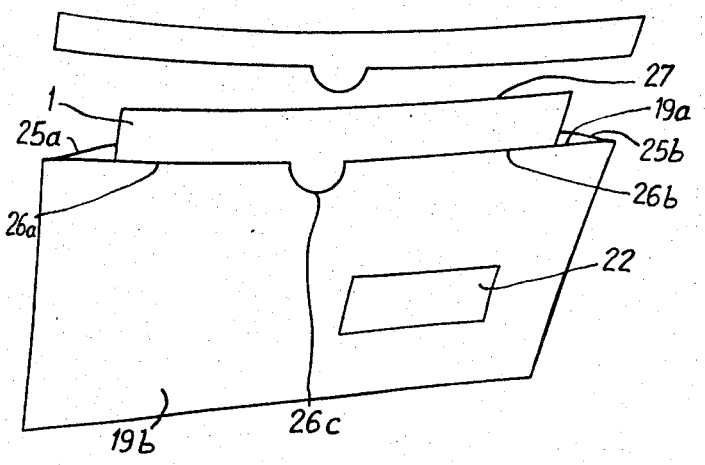
FIG. 8 shows the top opening means of a folder according to the embodiments of FIGS. 1 or 2 or 3*a*, 3*b* or 5*a*, 5*b*.

It is clear that after having torn off the marginal strips 6, it suffices to tear the superimposed lines 25 and 26 when the folder is sealed to open the latter, to release the incorporated document and to be able to seize the latter by means of the half-moon cut-out. If instead of detachable perforations, the segments 25*a*, 25*b*, 26*a*, 26*b* are breakage lines with weak attachments as well as the separating line 27, the opening of the folder and the extraction of the incorporated document is carried out simultaneously under the effect of a sudden pull exerted at the level of the half-moons (see FIG. 8).

This method of opening can also be applied to folders formed as has been mentioned with respect to FIGS. 1 and 2 by means of tear lines such as 8 and 13 (FIG. 1) comprising a half-moon cut-out such as 28 provided on the base strip and the cover strip.

Figure 9:
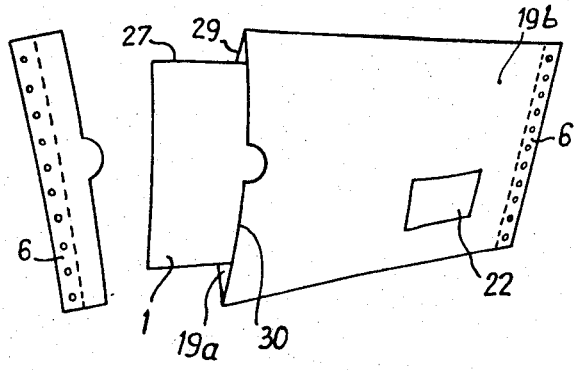
FIG. 9 shows the lateral opening means of an embodiment of a folder according to FIGS. 7*a*, 7*b*.

For the articles shown in FIGS. 7*a* and 7*b*, the opening of the folder is effected in the same manner by means of longitudinal tear lines 29, 30 with a half-moon cut-out, but the opening is done laterally (see FIG. 9). However, the incorporated document 1 can only be extracted by tearing and is unnecessary for the line of separation 27 from its flange to be a fragile rupture line. Of course, this lateral opening arrangement which is also that of currently known mailers can be adopted for the folders corresponding to FIGS. 1, 2 and 3*a*–3*b*, the tear lines being suitably arranged.

In FIGS. 10*a*–10*b* and 11*a*–11*b* a single panel of a continuous base strip is shown. This panel is divided into three flaps 31*a*, 31*b*, 31*c* by two parallel fold lines 32*a*, 32*b*. In the Examples shown the fold lines are transversal (with respect to the continuous base strip) and the flaps are equal or substantially equal but it is clear that the fold lines could be longitudinal and that one of the end flaps could be distinctly smaller than the two others. The incorporated document 1 is attached to one of the flaps by glueing at the top of its flange 2. Two lines of detachable perforations 33*a*–33*b* are formed on the panel parallel to and in the vicinity of the two sides perpendicular to the fold lines 32*a*, 32*b*.

Figure 10A:
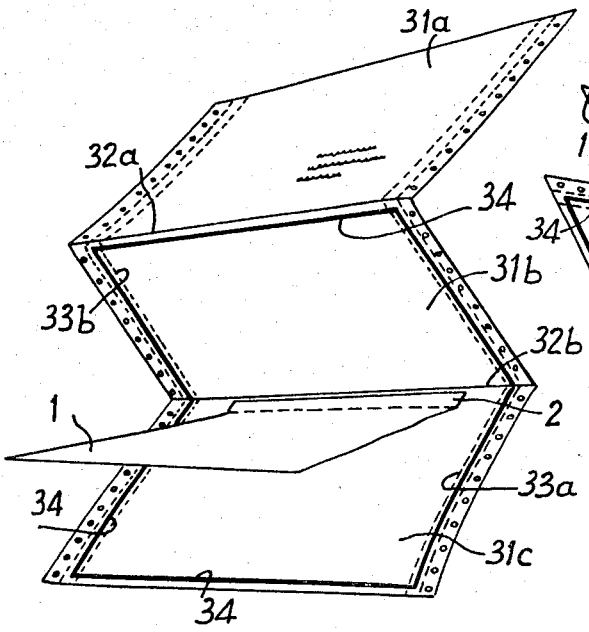
FIGS. 10*a* and 10*b* show a three flap folder designed to be folded in accordion style.
Figure 10B:
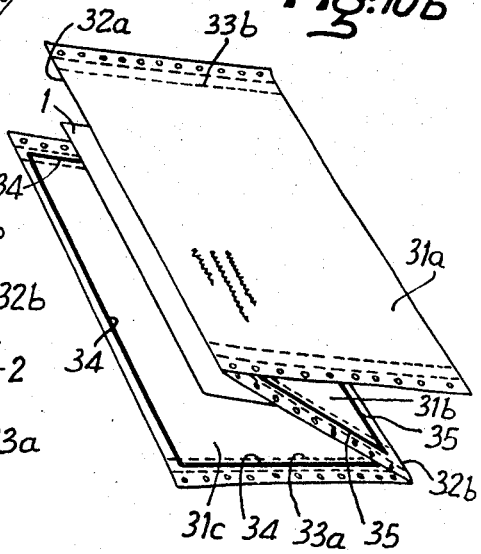

In FIGS. 10*a*–10*b*, the three flaps are designed to be folded in accordion fashion. The zone intended to receive the address of the proposed recipient is provided on the end flap 31*a* whose front comes to the outside of the sealed folder. This sealing is achieved by means of lines 34 of self-adhesive areas framing the front of the assembly formed by the two flaps 31*b* and 31*c*, and 35 framing the back of the assembly formed by the two flaps 31*a* and 31*b*. The opening of the folder is effected by tearing the two lines of perforations 33*a* and 33*b* and by unsticking the ends of the two end flaps.

Figure 11A:
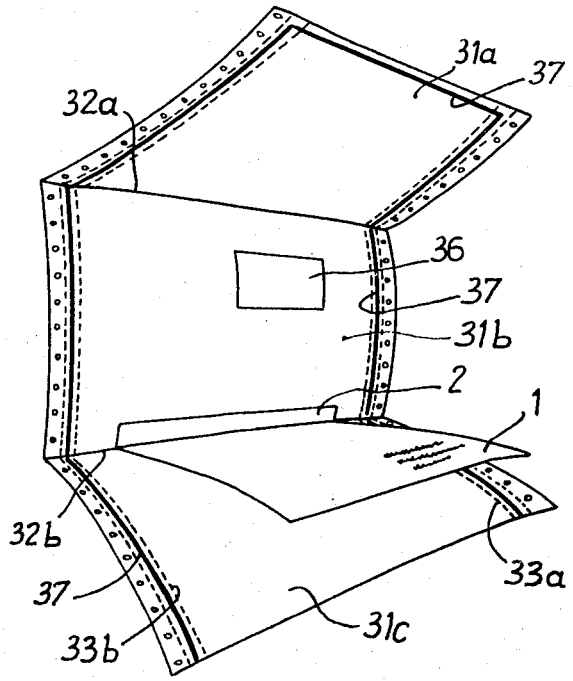
FIGS. 11*a* and 11*b* show also a three flap folder but provided for rolled folding.
Figure 11B:
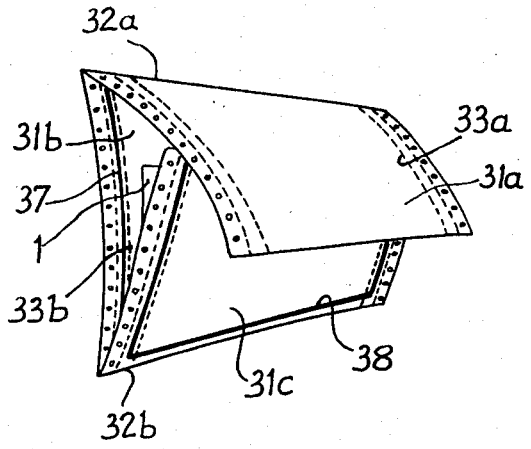

In FIGS. 11*a*–11*b* the three flaps are folded on one another by rolled folding. The document 1 is attached to one 31*c* of the end flaps. The zone intended to receive the address of the addressee is provided on the other end flap or, as in the Example shown, on the incorporated document and the central flap 31*b* is provided with a window 36 which comes to face the said zone when the folder is sealed. This sealing is achieved by means of lines 37 of self-adhesive areas borne by the front of the panel and 38 borne by the back of the flap 31*c* coming to the inside of the folder. The opening is effected by tearing the lines of perforations 33*a* and 33*b* and unsticking the end of the flap 31*a* forming the back of the folder.

Figure 12A:
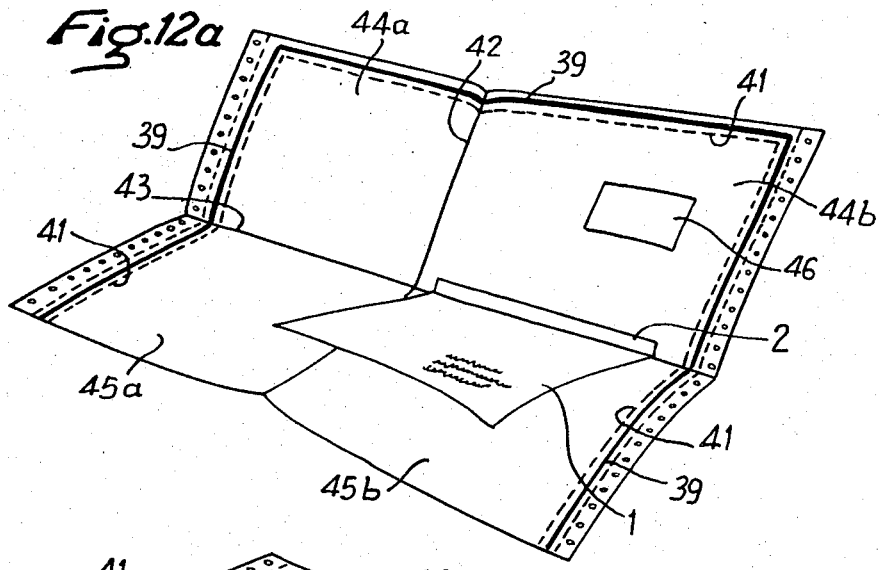
FIGS. 12*a*, 12*b* and 12*c* show respectively three phases of the cross-wise folding of a folder derived from a continuous assembly.
Figure 12B:
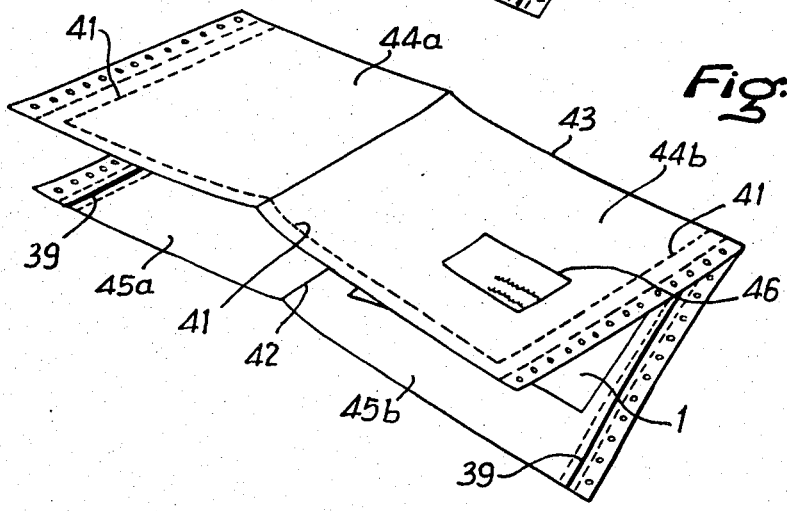
Figure 12C:
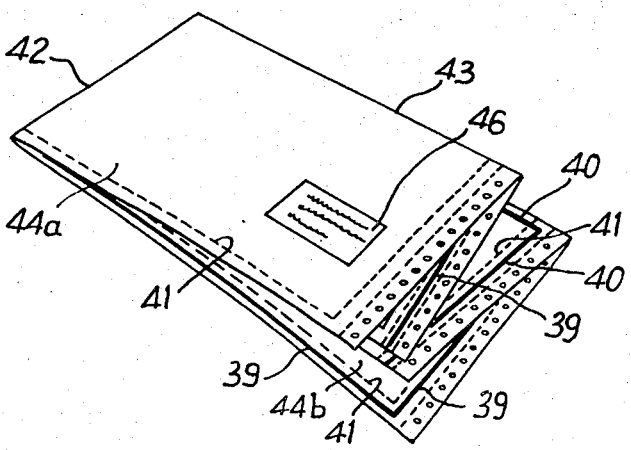

FIGS. 12*a*–12*b*–12*c* show one panel of a continuous base strip. The front of the panel carries the self- or thermo-adhesive lines 39 along three of its sides and parallel to the latter, slightly towards the inside, three lines 41 of detachable perforations. The panel comprises two cross-fold lines 42 and 43, one parallel to the free edge of the glueing means and the perforations being slightly displaced towards said edge with respect to the corresponding median of the panel and the other coinciding with the other median so as to form four equal boxes two by two on the panel, respectively 44*a*, 44*b* and 45*a*, 45*b*. In the Example shown the free edge of the glueing means is the lower transverse edge of the panel, the fold line displaced with respect to the corresponding median is the line 43, the boxes 44*a* and 44*b* being larger than the boxes 45*a* and 45*b*. The incorporated document 1 is attached to one of the boxes by glueing at the top of its flange 2. Self-adhesive lines 40 are provided on the back of the panel along and in the vicinity of the shifted fold lines 43 and, perpendicular to said line, along the sides of the small boxes 45*a* and 45*b*. One of the large boxes (here 44*b*) is provided with a window 46 which comes, after cross-folding of the panel, to face the zone of the small box opposite (or of the incorporated document when the latter is attached to said box as in the Example shown), provided to receive the address of the addressee.

The opening of the sealed folder is effected by tearing the lines of perforations 41, that is to say the two sides of the sealed folder which do not correspond to the fold and unsticking lines of the self-adhesive line along the shifted fold line 43.

In all the embodiments including lines of self-adhesive areas, in order not to interfere with the accordion style folding of the continuous base strip, said areas are placed according to the arrangements provided in French Patents 1,215,307 or 75 12 994 of Applicant.

Of course, any type of printing can be carried out before the assembling outside of the zones of the base strip and of the elements of the incorporated document intended to receive printed information.

When windows are provided, the latter may be closed by an attached transparent leaf.

It must be understood that the expression "attached to a flap (or a box)" applied to the incorporated document, signifies that the document covers said flap or said box at least partially, but that its flange can be glued to an adjacent flap (or box), the separation line of said flange coinciding with the fold line separating the flaps (or boxes) concerned when this line is transversal, as is the case shown in FIGS. 11*a*–11*b*, 12*a*–12*b*–12*c* but which could also be the case for FIGS. 6*a*–6*b*, 7*a*–7*b* or 10*a*–10*b*.

Lastly, if in all the Examples described and shown, each folder is formed from a complete panel of the continuous base strip, it must be clear, notably when the folders are sealed by folding around transverse lines (FIGS. 5*a*–5*b*, 6*a*–6*b*, 7*a*–7*b*, 10*a*–10*b* and 11*a*–11*b*) and when a Y impression printer is available, that each panel of the base strip can comprise two folders placed side by side. In this case the machine performing the separation into units must comprise a median longitudinal cutting means for the assembly.

I claim:

1. Continuous assembly of mailers with incorporated documents, said assembly comprising a continuous base strip divided into panels, each panel being bounded by two transverse lines of weakness providing for the accordion-folding of said continuous strip, longitudinally extending drive means along both of the side edges of said base strip enabling said strip to be driven in a printing machine, at least some of the panels having incorporated document means comprising leaf means each having a top flange and a detachable portion defined by a tear line of perforations, each leaf flange being fastened by glueing at the top of the panel and transversely of the base strip so as to be perpendicular to the direction of movement of the base strip through a printing machine, said assembly being arranged to form a plurality of sealed folders by glueing, wherein the folders are sealed after their passage through the printing machine, a tear line of perforations on said base strip extending transversely between said longitudinally extending drive means and arranged to coincide with the tear line defining said detachable portion, and wherein each panel of the base strip is divided into two flaps foldable upon one another on a fold line constituting the longitudinal median of the panel concerned, and adhesive areas extending parallel to each of the four sides of each panel and at a short distance from said sides on the front of the strip and the incorporated documents means on each panel is attached to one of the flaps while the other flap is provided with a window arranged to overlie the zone of the first element of the incorporated document means which receives the address of the addressee by direct impression of the printing machine.

2. Continuous assembly of mailers with incorporated documents, said assembly comprising a continuous base strip divided into panels, each panel being bounded by two transverse lines of weakness providing for the accordion-folding of said continuous strip, longitudinal means enabling said strip to be driven in a printing machine, at least some of the panels having incorporated document means comprising leaf means each having a top flange and a detachable portion, each leaf flange being fastened by glueing at the top of the panel and transversely of the base strip so as to be perpendicular to the direction of movement of the base strip through a printing machine, said assembly being arranged to form a plurality of sealed folders by glueing the continuous base strip provided with attached incorporated documents means onto a continuous cover strip of substantially the same width by means of glue stripes adjacent each of the four sides of each panel, and at least the top leaf means of each incorporated document means having reproducing means that enable it to receive impressions of a printing machine through said cover strip, and a continuous recording strip coinciding with the continuous cover strip but separated therefrom and held to the assembly by temporary fastening means so as to obtain a selective transfer of the impression of the printing machine on the front of the cover strip through the recording strip.

3. Continuous assembly of mailers according to claim 2, wherein the base strip and the cover strip each include a transverse line of detachable perforations coinciding with the line of separation of the top flange from the detachable portion of the incorporated document means, the line of detachable perforations on the cover panel being interrupted in its median portion to form two segments joined by a half-moon cut, so that each sealed folder opens from the top by tearing along said line of perforations.

4. Continuous assembly of mailers according to claim 2, wherein each of the two flaps of each panel include a transverse line of detachable perforations coinciding with the line of separation of the top flange from the detachable portion of the incorporated document means, the line of detachable perforations on the cover fold being interrupted in its median portion to form two segments joined by a half-moon cut, so that each sealed folder opens from the top by tearing along said line of perforations.

5. Continuous assembly of mailers with incorporated documents, said assembly comprising a continuous base strip divided into panels, each panel being bounded by two transverse lines of weakness providing for the accordion-folding of said continuous strip, longidutinal means enabling said strip to be drivein in a printing machine, at least some of the panels having incorporated document means comprising leaf means each having a top flange and a detachable portion, each leaf flange being fastened by glueing at the top of the panel and trasnversely of the base strip so as to be perpendicular to the direction of movement of the base strip through a printing machine, said assembly being arranged to form a plurality of sealed folders by glueing after their passage through a printing machine, wherein the continuous base strip provided with attached incorporated document means is fastened to a continuous cover strip of substantially the same width by means of adhesive means extending substantially parallel to each of the four sides of each panel and adjacent thereto between the base strip and the cover strip, the said cover strip having a window overlying the top leaf means of the incorporated documents means so this leaf means receives from the printing machine the address of the addressee by direct impression.

* * * * *